United States Patent [19]

Bunnell et al.

[11] 4,240,687

[45] Dec. 23, 1980

[54] TRANSITION BLOCK FOR TERMINATING FLAT CONDUCTORS

[75] Inventors: Edward D. Bunnell, Palm Harbor; Thomas J. Sotolongo, Clearwater Beach, both of Fla.

[73] Assignee: AMP Incorporated, Harrisburg, Pa.

[21] Appl. No.: 43,769

[22] Filed: May 30, 1979

[51] Int. Cl.[3] ..... H01R 9/08

[52] U.S. Cl. ..... 339/99 R; 339/176 MF

[58] Field of Search ..... 339/17 F, 97-99, 339/176 MF, 198 R, 263 R

[56] References Cited

U.S. PATENT DOCUMENTS

| | | | |
|---|---|---|---|
| 2,957,157 | 10/1960 | Carter | 339/263 R |
| 3,702,982 | 11/1972 | Kelly et al. | 339/176 MF |
| 3,777,049 | 12/1973 | Gillemot et al. | 339/97 R |

FOREIGN PATENT DOCUMENTS

| | | | |
|---|---|---|---|
| 2309236 | 8/1974 | Fed. Rep. of Germany | 339/99 R |

OTHER PUBLICATIONS

Product Engineering Design Manual, McGraw Hill, Molded Plastic Parts, pp. 170, 171, published 1959.

*Primary Examiner*—Neil Abrams

*Attorney, Agent, or Firm*—Anthony S. Volpe; F. Brice Faller

[57] ABSTRACT

A transition block connector for use in interconnecting flat conductors and round conductors which provides a minimum connection profile. The connector employs formed contacts which pierce the flat conductor insulation to establish electrical contact without conductor damage, and standard round wire screw type termination.

7 Claims, 10 Drawing Figures

52
74
72
80
78
76
70
66
50
24
28
26
23
20
22
36
30
32
44
35
38
42
43
92
90
94
96
62
60
56
54
58
2
10
4
6

TRANSITION BLOCK FOR TERMINATING FLAT CONDUCTORS

BACKGROUND OF THE INVENTION

1. Field of the Invention

The present invention is for use in interconnecting flat conductor cable, which generally comprises a tape-like strip of suitable insulation in which there are embedded a plurality of ribbon-like conductors extending parallel to each other, with standard round wire conductors. Flat conductor cable has been widely available for some years although conventional terminating and crimping techniques as are commonly applied to round wires are not applicable to this type of cable and transition from flat to round conductors is a major problem, especially in existing systems. A wide variety of specialized types of connecting devices have been developed for flat conductor cable but little has been done to afford suitable transition connectors.

2. Description of the Prior Art

The prior art shows a number of connectors for flat conductor cables or round wire conductors, however, the prior art devices generally are unsatisfactory for transition between different conductor systems. The present invention solves the prior art problems by providing a transition connector with a minimum termination profile and simplified termination.

BRIEF SUMMARY OF THE INVENTION

A transition block for interconnecting round and flat conductor systems is disclosed. It is the primary object of this invention to provide a flat conductor termination which requires no special cable preparation in addition to using standard round conductor techniques. It is another object of this invention to provide an interconnection with a minimum profile. It is another object of this invention to provide a transition block which may be used for pass through or butt connection to the flat conductors.

DESCRIPTION OF THE PREFERRED EMBODIMENT

Figure 1:
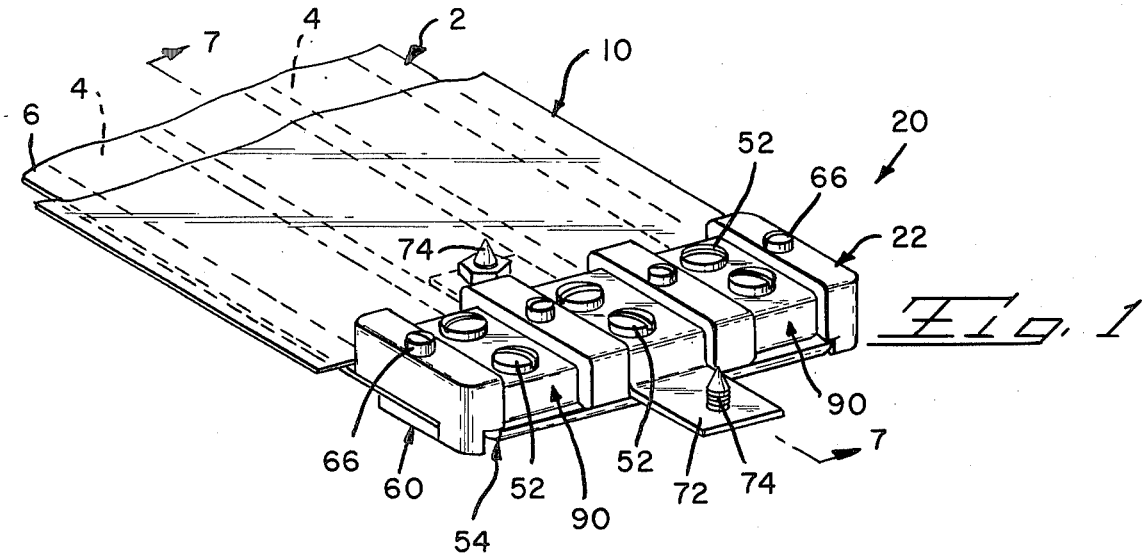
FIG. 1 shows the transition block of the instant invention as assembled in a butt condition.

FIG. 1 illustrates a transition block 20 according to the preferred embodiment of the invention terminated to the butt end of a flat conductor cable 2. Cable 2 has a plurality of flat conductors 4 with an approximate thickness of 0.009 in. (0.2286 mm) and an approximate width of 0.625 in. (15.875 mm) which are individually encased in an insulating carrier 6 which in the preferred cable is two layers of approximately 0.006 in. (0.1524 mm) thick Mylar. The cable 2 represents a normal three conductor system of hot, ground and neutral. The cable shield 10 is of a conductive material, i.e. rolled steel 0.009 in. (0.2286 mm) thick which runs the entire length of cable 2 and is approximately five inches or 127 mm wide.

Figures 2, 3:
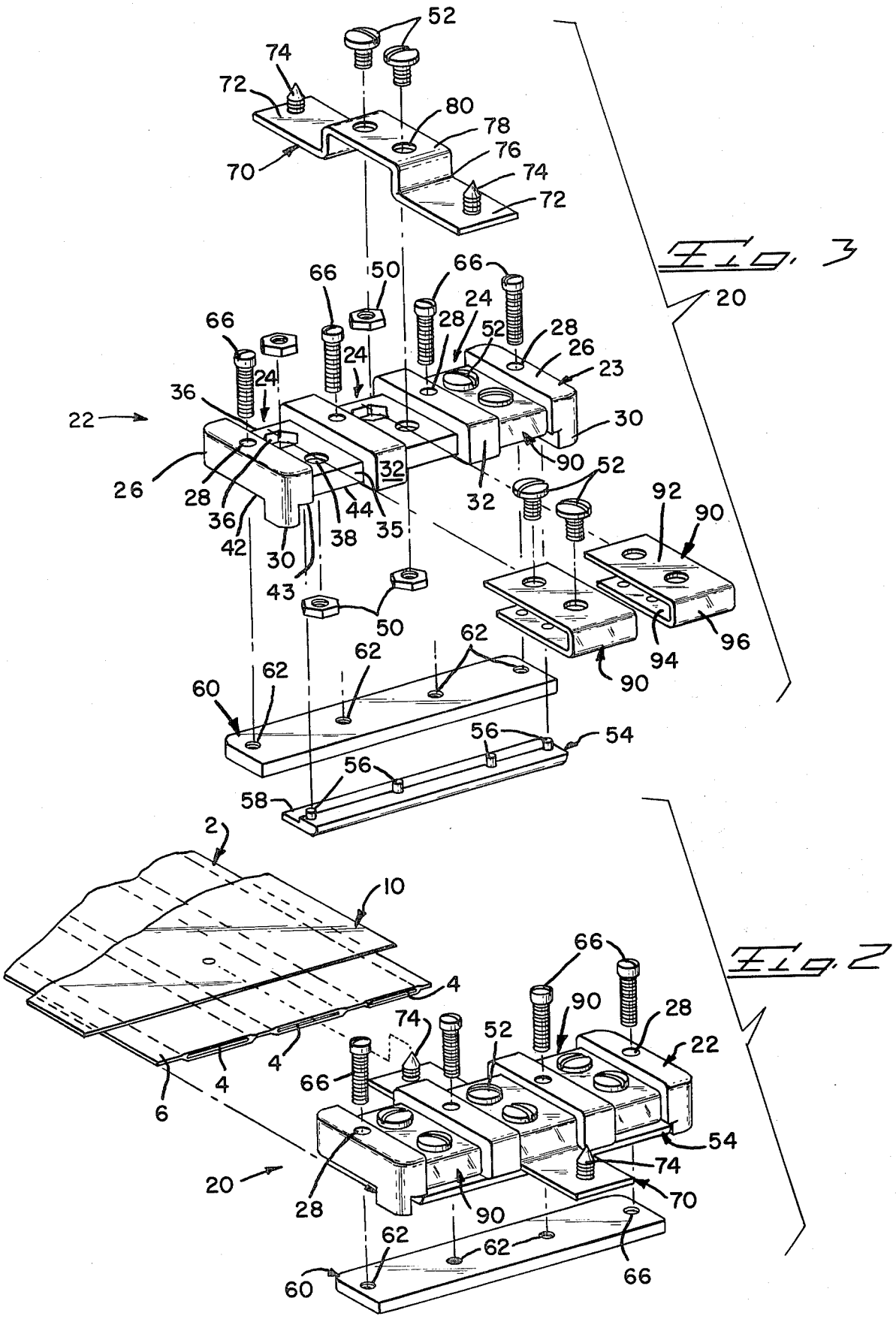
FIG. 2 shows the termination of FIG. 1 in an exploded view.
FIG. 3 is an exploded view of a transition block.

FIG. 2 illustrates the transition block 20 of FIG. 1 exploded away from the cable 2 and cable shield 10 just prior to application. Referring now to FIG. 3, there is shown an exploded transition block 20. Body 22 is of dielectric material and has a first surface 23 molded with three first planar recesses 24 defined through the cooperation of end walls 26 and ribs 32. End walls 26 and ribs 32 have passageways 28 therethrough. Legs 30 are integral with endwalls 26 and extend beyond the mounting surface 42 of endwall 26.

Figure 4:
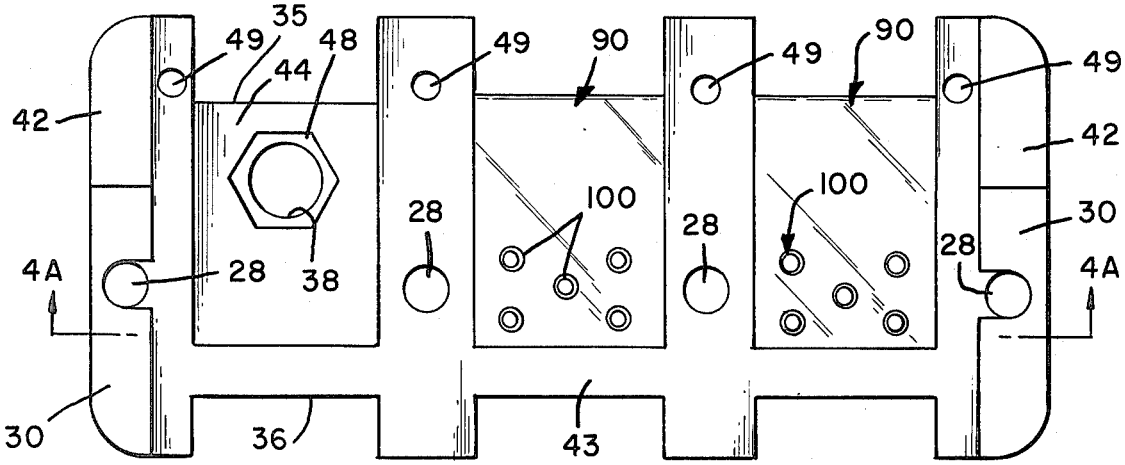
FIG. 4 is a plan view of the flat cable termination area.
Figure 4A:
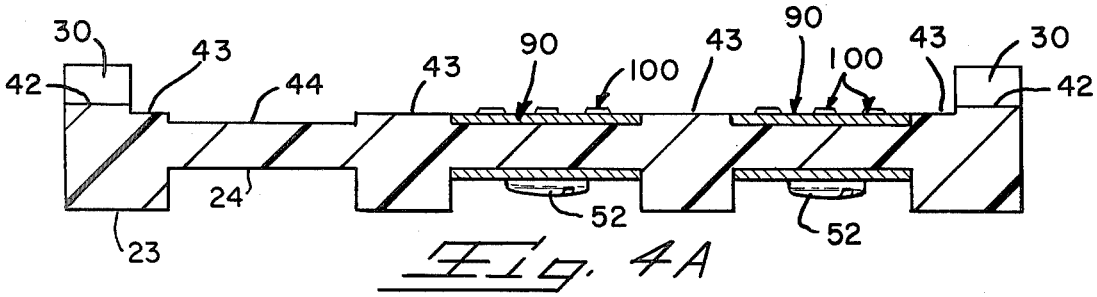
FIG. 4A is a section through the lines A—A of FIG. 4.

First planar recesses 24 communicate with sides 35, 36 which are recessed from sidewalls extendling along either side of body 22. Each recess 24 has hexagonal cavity 36 therein and hole 38 therethrough. A second surface 43 of body 22 is more easily explained with reference to FIGS. 4 and 4A. FIG. 4 is a plan view of the second surface 43 of body 22 and FIG. 4A is a section through the line A—A. Second surface 43 is recessed below mounting surface 42 by approximately 0.020 (5.08 mm). Second planar recess 44 is molded into second surface 43 for the entire width of first planar recess 24 and extends from one side 35 to a point just before the other side 36. As can be seen in FIG. 4A, second recess 44 is of a depth approximately equal to the thickness of the material used for fabricating terminal 90, which in the preferred embodiment is approximately 0.020 in. (5.08 mm) thick brass. Hexagonal cavity 48 is molded in second recess 44 and on centerline with hole 38. As shown in FIG. 3, hexagonal cavities 36 and 48 receive hexagonal nuts 50 for securing screws 52 to standard round conductor. However, it is understood that body 22 could be molded with threads therein or holes which would permit the use of self tapping screws. Holes 49 are dimensioned and positioned to secure a butt plate 54 to body 22. Butt plate 54 of FIG. 3 is of dielectric material and provides a closure to protect the exposed conductor ends of cable 2.

Referring again to FIG. 3, it can be seen that butt plate 54 has posts 56 which are dimensioned for interference fit with holes 49. Recess 58 provides cable clearance. Termination plate 60 is a steel bar dimensioned to compliment legs 30 and has screw threads 62 drilled and tapped on centerlines with passageways 28 for securing termination plate 60 to body 22 via screws 66.

Shielding terminal 70 is of conductive material such as 0.020 in. (5.08 mm) hardened brass. The flanges 72 are integral with raised center member 78 and are scored at 76 to permit the breaking away of one flange 72 for butt splicing. Threaded posts 74 are rigidly secured to flanges 72 and receive nuts to secure the shield 10 and establish electrical continuity. Center member 78 is large enough to fit over a terminal 90 positioned in first planar recess 24. The holes 80 permit the securing of screws 52 to nuts 50.

Figure 5:
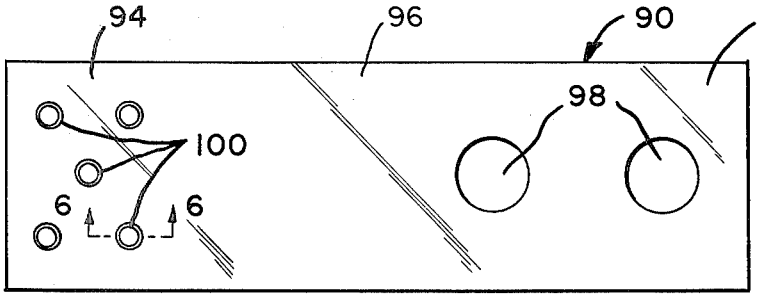
FIG. 5 is a plan view of a contact terminal prior to forming.
Figure 6:
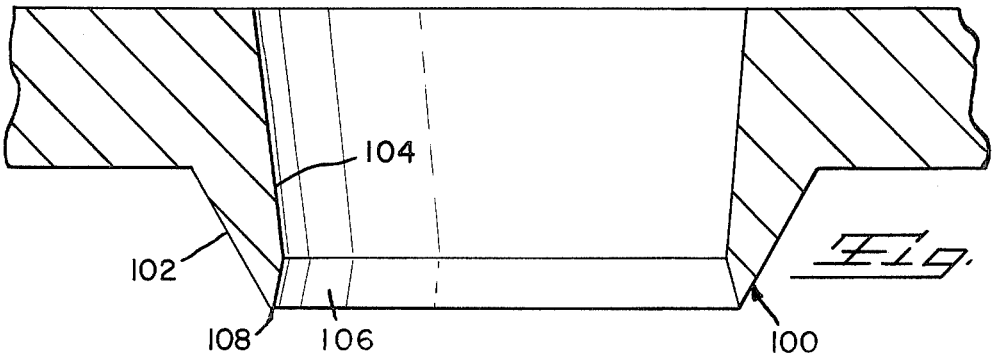
FIG. 6 is an enlarged sectional view of a single contact ring exploded out of a terminal.

The terminal 90 as shown in FIG. 3 is generally U-shaped with an upper or first leaf 92, a lower or second leaf 94 and a common web 96. Terminal 90 is formed from a blank as shown in FIG. 5. The preferred material is 0.020 in. (5.08 mm) #2 hardened brass. The upper leaf 92 has holes which are sized to permit the shank of screw 52 to pass through. Lower leaf 94 has a plurality of stamped and formed contact rings 100. The structure of contact rings is best seen with reference to FIG. 6 which is a section through the lines 6—6 of FIG. 5. The contact ring is formed by first prepunching a 0.032 in. (0.8128 mm) hole on the desired center. The hole is then formed into a contact ring through a punch and die operation. A punch with approximately a 0.062 in. (1.5748) diameter is passed through the prepunched hole. A cooperating die having a depth of approximately 0.020 in. (5.08 mm) is tapered inward from approximately a 0.085 in. diameter at a 60° angle with respect to an imaginary center line. This metal forming operation results in a contact ring having a tapered outer ring 102, a first inner ring 104 which generally conforms to the second punch configuration and a second inner ring 106 which tapers outward to meet out ring 102 at edge 108. Edge 108 has a maximum flat of 0.002 in. (0.0508 mm). The taper of inner ring 106 is achieved through the combination of prepunching and metal working during the punch and die operation. Referring again to FIG. 3, it can be seen that terminal 90 is then folded into shape with the inner height of web 96 being approximately equal to side 35 of body 22.

Figure 9:
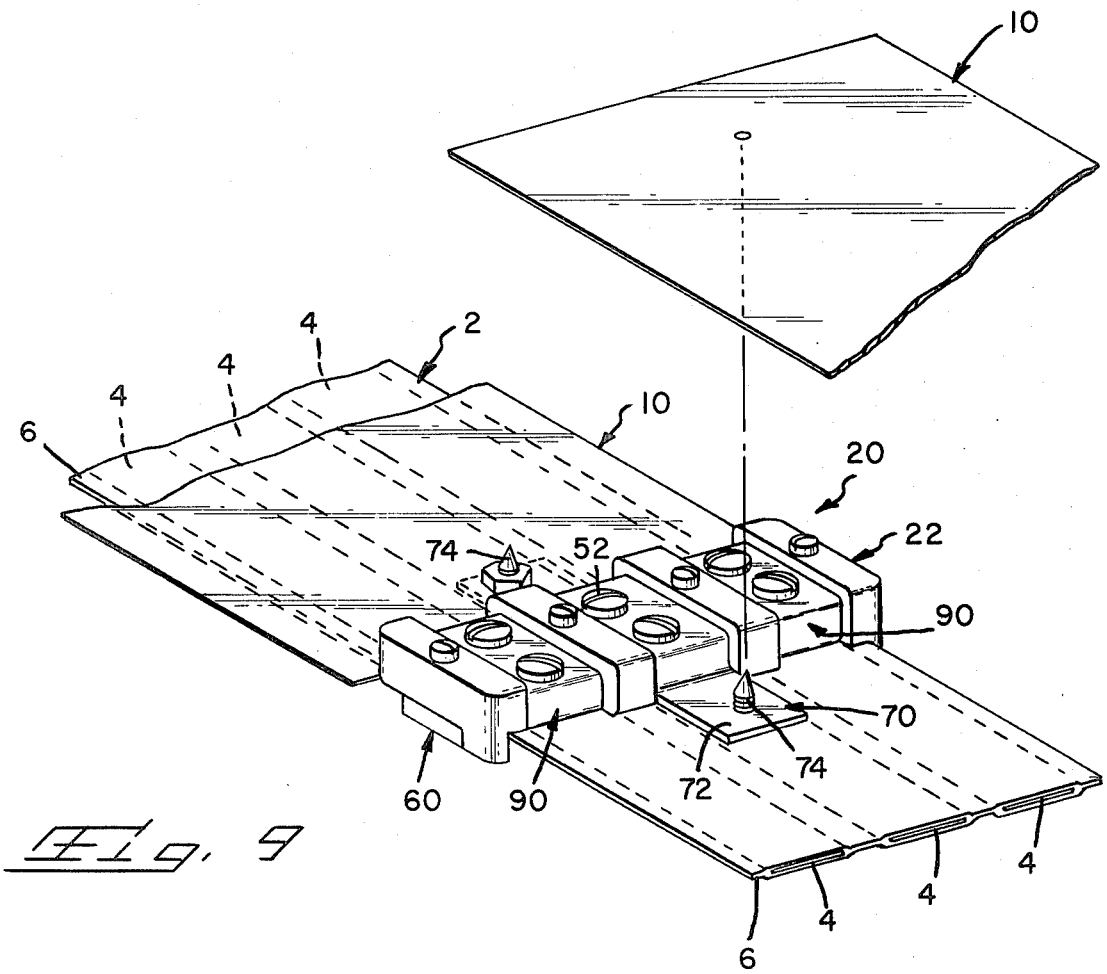
FIG. 9 shows the termination block of the instant invention assembled in a cable through condition.
Figure 7:
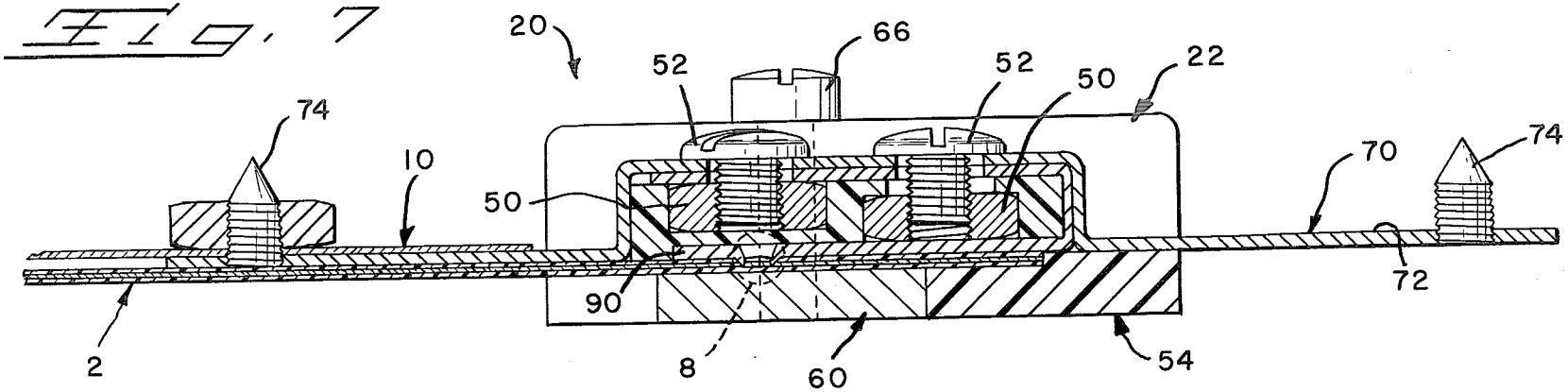
FIG. 7 is a section through the lines 7—7 of FIG. 1.
Figure 8:
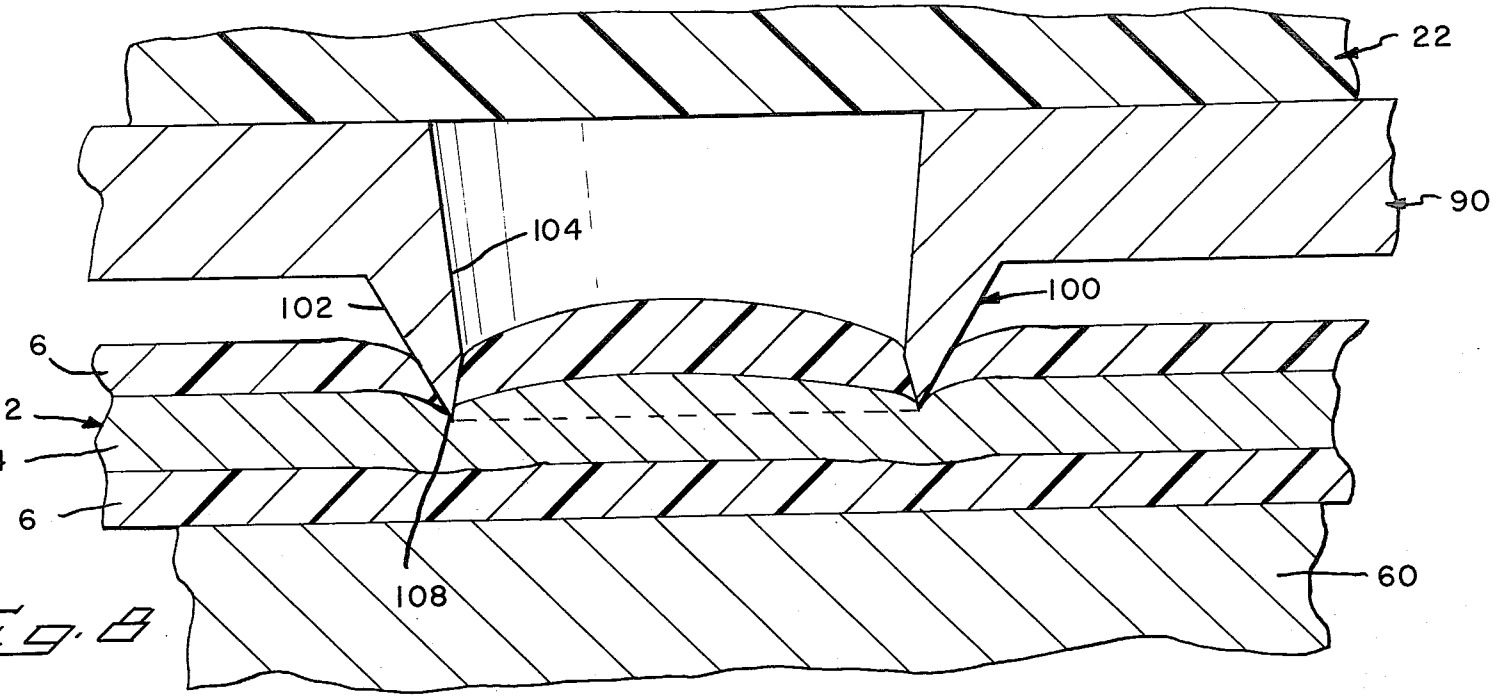
FIG. 8 is an enlarged sectional view of a single contact as shown in FIG. 7.

FIG. 2 shows a complete transition block 20 prior to termination. The termination is achieved by locating the cable 2 over second surface 43, termination plate 60 is located under cable 2 in alignment with body 22. The screws 66 are secured in holes 62 to draw the cable into contact with terminal 90. The ground shield 10 is then located over stud 74 of ground terminal 70 and secured. For a butt termination, as shown in FIG. 2, the unused flange 72 may be removed by bending along score line 76. FIG. 9 illustrates a similar termination for a pass through transition block 20. FIG. 7 illustrates the mechanical termination of the transition block and FIG. 8 illustrates the electrical termination of a contact ring 100. Note that the contact ring 100 severs the insulation 6 and embeds itself in the conductor 4 without cutting through the conductor. Damage to the conductor 4 is limited by assuring dimensional cooperating among termination plate 60, mounting surface 42, second surface 43 and contact ring 100. The termination area is shown in FIG. 8, note that the conductor is uncut and dimpled.

Although preferred embodiments of the present invention are disclosed and shown in detail, other modifications and embodiments which would be apparent to one having ordinary skill in the art, are intended to be covered by the spirit and scope of the claims.

What is claimed is:

1. A transition block for interconnecting an insulated flat conductor cable to round conductors comprising:

a low profile generally rectangular dielectric body having a generally planar first surface, a generally planar second surface on the opposite side of said body from said first surface, a pair of opposed sidewalls, and a pair of opposed endwalls, said first surface having a plurality of said first planar recesses therein, said second surface having a like plurality of second planar recesses therein, said recesses communicating with one sidewall of said body, said body having a bore means therein extending perpendicularly inward from each said first recess, said bore means having threaded means therein, a like plurality of terminals formed from conductive sheet stock, said terminals each having a generally planar first leaf, a generally planar second leaf parallel to said first leaf, and a common web, said first and second leaves being dimensioned for reception in said first and second recesses respectively, said first leaf having a hole therein, said second leaf having projections on the surface thereof facing opposite said first leaf, said projections having a height at least equal to the thickness of insulation on one side of a flat conductor, a like plurality of screws having shanks dimensioned to fit within the holes in the first leaves and into said bore means, said shank having threads profiled to mate with said threaded means, a termination plate dimensioned to fit over said second planar recesses, means for securing said termination plate to said body, whereby, said terminals may be assembled to said body with said first leaves in said first recesses, said second leaves in said second recesses, and said webs adjacent said one sidewall, said insulated flat conductor cable may be positioned adjacent to said second surface with each conductor therein adjacent to a second leaf, said termination plate may be secured to said body causing said projections to pierce said insulation and make contact with said conductors, and said screws may be inserted through said holes in said first leaves into said threaded means to secure said first leaf to said body and to provide means for terminating a round conductor.

2. The transition block of claim 1 wherein said projections are contact rings, each contact ring being formed about a hole through said second leaf, each said contact ring having an edge lying at a uniform distance from said second leaf, whereby said edge pierces said insulation and makes contact with said conductor uniformly about the perimeter of said ring.

3. The transition block of claim 1 wherein damage to the conductors is limited by providing dimensional cooperation among said termination plate, said second surface, said second planar recesses, and said projections.

4. The transition block of claim 3 wherein said dimensional cooperation is provided by dimensioning said second planar recesses such that said second leaves are flush with said second surface, and by providing mounting surfaces for the termination plate on the second surface at the endwalls, positioned for reception of the flat cable therebetween and of a height less than the sum of the height of a projection plus one thickness of insulation plus the thickness of the conductor but greater than the height of a projection plus one thickness of insulation.

5. The transition block of claim 4 wherein said means for securing said termination plate to said body comprises a passageway extending perpendicularly from said first surface through the body to each mounting surface, threaded bores through each end of said termination plate for alignment with said passageways, and a pair of screws.

6. The transition block of claim 1 wherein each said bore means extend through said body from said first recess to said second recess and comprises a hexagonal cavity inset from said second recess and dimensioned to accommodate a hexagonal nut, said threaded means comprising said nut, said bore means between said hexagonal cavity and said first surface being of smaller dimension than said nut.

7. A transition block for interconnecting an insulated flat conductor cable to round conductors comprising:

a plurality of terminals formed from conductive sheet stock, said terminals each having a generally planar first leaf, a generally planar second leaf parallel to said first leaf, and a common web, said first leaf having a hole therein, said second leaf having projections on the surface thereof facing opposite said first leaf, said projections having a height at least equal to the thickness of insulation on one side of a flat conductor, a low profile generally rectangular dielectric body having a first surface, a second surface on the opposite side of said body from said first surface, a pair of opposed sidewalls, and a pair of opposed endwalls, said body having a like plurality of bore means therein extending perpendicularly inward from said first surface, said bore means having threaded means therein, said body being profiled for close reception of said terminals with said holes aligning with said bore means, and said projections projecting above said second surface for a height at least equal to the thickness of insulation on one side of a flat conductor, a like plurality of screws having shanks dimensioned to fit within the holes in the first leaves and into said bore means, said shank having threads profiled to mate with said thread means, a termination plate dimensioned to fit over said second surface, means for securing said termination plate to said body, whereby, said terminals may be assembled to said body with said first leaves against said first surface and said holes aligned with said bore means, said second leaves against said second surface and said webs adjacent said one sidewall, said insulated flat conductor cable may be positioned adjacent to said second cable with each conductor therein adjacent to a second leaf, said termination plate may be secured to said body causing said projections to pierce said insulation and make contact with said conductors and said screws may be inserted through said holes in said first leaves into said threaded means to secure said first leaf to said body and to provide means for terminating a round conductor.

* * * * *